US006309784B1

(12) United States Patent
Black et al.

(10) Patent No.: US 6,309,784 B1
(45) Date of Patent: Oct. 30, 2001

(54) CHARGE TRANSPORT LAYERS AND/OR CHARGE GENERATION LAYERS COMPRISING UNSATURATED ALIPHATIC HYDROCARBONS AND PHOTOCONDUCTORS INCLUDING THE SAME

(75) Inventors: David Glenn Black, Boulder; Dat Quoc Nguyen, Platteville; Kasturi R. Srinivasan, Longmont, all of CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/503,792

(22) Filed: Feb. 14, 2000

(51) Int. Cl.[7] ..... G03G 5/05

(52) U.S. Cl. ..... 430/56; 430/59.6; 430/96; 252/501.1; 252/500

(58) Field of Search ..... 430/56, 59.6, 127, 430/130, 135; 252/500, 501.1

(56) References Cited

U.S. PATENT DOCUMENTS 5,382,488 * 1/1995 Kato et al. ..... 430/96
6,110,628 * 8/2000 Sekiya et al. ..... 430/58.05
6,165,662 * 12/2000 Kato et al. ..... 430/96

FOREIGN PATENT DOCUMENTS 0852342 7/1998 (EP) .

* cited by examiner

*Primary Examiner*—John Goodrow
(74) *Attorney, Agent, or Firm*—John A. Brady

(57) ABSTRACT

Charge generation layers comprise a binder including an unsaturated aliphatic hydrocarbon and charge generation compound, wherein the unsaturated, aliphatic hydrocarbon comprises at least 10 carbon atoms. Charge transport layers comprise one or more unsaturated aliphatic hydrocarbons and a charge transport compound, wherein the unsaturated hydrocarbon comprises at least 10 carbon atoms. Dual layer photoconductors comprise a substrate, a charge transport layer and a charge generation layer, wherein at least one of the charge generation layer or charge transport layer comprise one or more unsaturated aliphatic hydrocarbons having at least 10 carbon atoms.

32 Claims, 1 Drawing Sheet

CHARGE TRANSPORT LAYERS AND/OR CHARGE GENERATION LAYERS COMPRISING UNSATURATED ALIPHATIC HYDROCARBONS AND PHOTOCONDUCTORS INCLUDING THE SAME

FIELD OF THE INVENTION

The present invention is directed to charge transport layers and/or charge generation layers which comprise one or more unsaturated aliphatic hydrocarbons. This invention is also directed to photoconductors including such charge transport layers and/or charge generation layers.

BACKGROUND OF THE INVENTION

In electrophotography, a latent image is created on the surface of an imaging member which is a photoconducting material by first uniformly charging the surface and selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on depending on the relative electrostatic charges on the photoconductor surface, the development electrode and the toner.

Typically, a dual layer electrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to the use of a charge transport layer which comprises a hole transport material as the charge transport compound. One skilled in the art will appreciate that if the charge transport layer contains electron transport material rather than a hole transport material, the charge placed on the photoconductor surface will be opposite that described herein.

When the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface. Conventionally, the charge generation layer is comprised of the charge generation compound or molecule alone and/or in combination with a binder. The charge transport layer typically comprises a polymeric binder containing the charge transport compound or molecule. The charge generation compounds within the charge generation layer are sensitive to image-forming radiation and photogenerate electron hole pairs therein as a result of absorbing such radiation. The charge transport layer is usually non-absorbent of the image-forming radiation and the charge transport compounds serve to transport holes to the surface of a negatively charged photoconductor. Photoconductors of this type are disclosed in the Adley et al. U.S. Pat. No. 5,130,215 and the Balthis et al. U.S. Pat. No. 5,545,499.

A common phenomena observed with dual layer organic photoconductors is positive electrical fatigue which causes lower residual potential with cycling. Photoconductor electrical fatigue is observed as a change in discharge voltage versus exposure energy upon electrical or print cycling. Positive photoconductor fatigue contributes to darkening print copy over life of a photoconductor.

Photoconductor drums are frequently handled by operators during drum inspection or cartridge assembly. Contamination of the photoconductor drum can occur by hand or food oils during this handling by operators. This contamination often leads to crazing of the photoconductor drum. Crazing is a term used to define the cracking of a polymer surface induced by contamination by hand or food oils. Crazing can effect the life and photoelectric qualities of the photoconductor.

As such, there is a need for photoconductors, charge generation layers and charge transport layers which increase photoconductor stability, reduce positive electrical fatigue, induce negative electrical fatigue in which the residual potential increases with cycling, and/or prevent or mitigate crazing of the drums.

SUMMARY OF THE INVENTION

Accordingly, it is the object of the present invention to provide novel charge transport layers and/or charge generation layers which overcome one or more disadvantages of the prior art. It is a more specific object of the invention to provide charge transport layers and/or charge generation layers which reduce or eliminate photoconductor electrical fatigue and/or crazing in photoconductors.

These and additional objects are provided by charge transport layers, charge generation layers and/or photoconductors including the same of the present invention.

In one aspect of the invention, the charge transport layer is comprised of charge transport compound and one or more unsaturated aliphatic hydrocarbons, wherein the unsaturated aliphatic hydrocarbon comprises at least 10 carbon atoms.

Another embodiment of the present invention is directed to a charge generation layer comprising a binder and a charge generation compound, wherein the binder comprises an unsaturated aliphatic hydrocarbon which comprises at least 10 carbon atoms.

Another embodiment of the present invention is directed to a photoconductor comprising a substrate, a charge generation layer, and a charge transport layer, wherein at least one of the charge transport layer and the charge generation layer comprise one or more unsaturated aliphatic hydrocarbons having at least 10 carbon atoms.

These and additional objects and advantages will be more readily apparent in view of the following detailed description.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION

Figure 1:
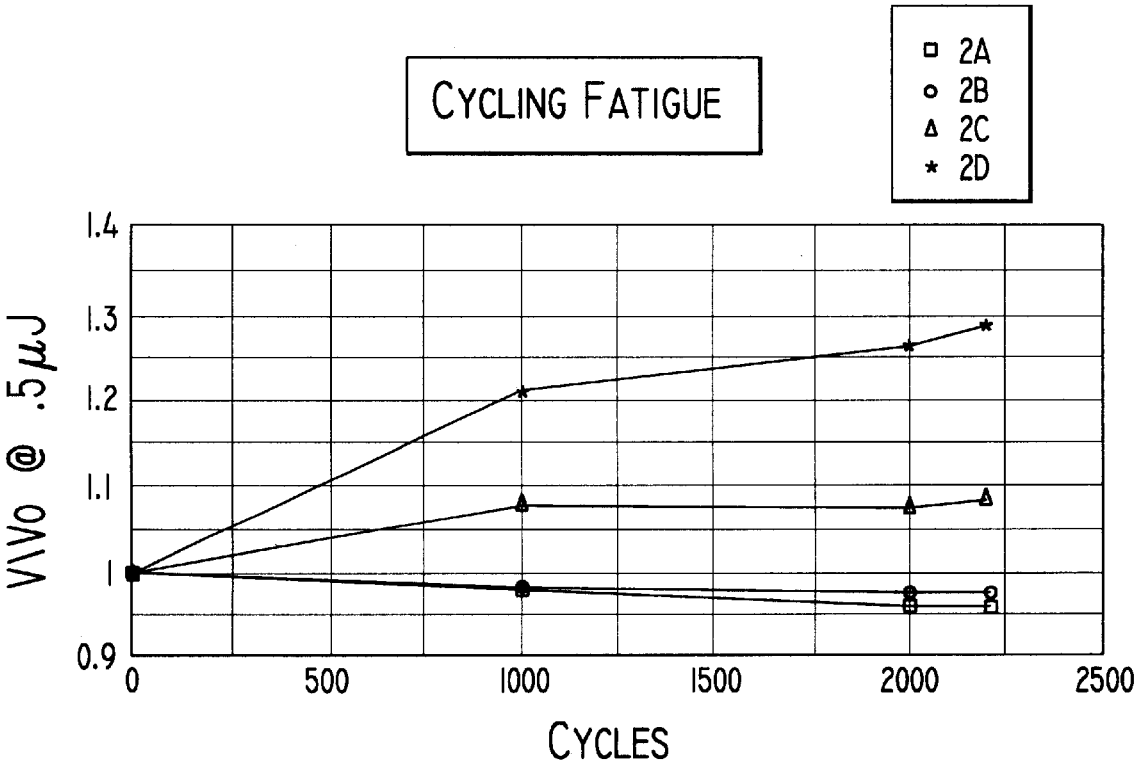
FIG. 1 sets forth electrical performance properties of photoconductors comprising unsaturated aliphatic hydrocarbons of the present invention and comparative photoconductors.

The charge transport layers and charge generation layers according to the present invention are suitable for use in dual layer photoconductors. Such photoconductors generally comprise a substrate, a charge generation layer and a charge transport layer. While various embodiments of the invention discussed herein refer to a charge generation layer as being formed on the substrate, with a charge transport layer formed on the charge generation layer, it is equally within the scope of the present invention for the charge transport layer to be formed on the substrate with a charge generation layer formed on the charge transport layer.

The present invention is directed to charge transport layers, charge generation layers and/or photoconductors containing one or more unsaturated aliphatic hydrocarbon compounds.

In one embodiment of the present invention, a charge transport layer comprises a charge transport compound and one or more unsaturated aliphatic hydrocarbons, wherein the unsaturated aliphatic hydrocarbon comprises at least 10 carbon atoms. In addition, the charge transport layer of the present invention may also comprise a binder. Typically, the binder is polymeric and may comprise, but is not limited to, vinyl polymers such as polyvinyl chloride, polyvinylbutyral, polyvinyl acetate, styrene polymers and copolymers of these vinyl polymers, acrylic acid and acrylic polymers and copolymers, polycarbonate polymers and copolymers, including polycarbonate-A, which is derived from bisphenol-A, polycarbonate-Z, which is derived from cyclohexylidene bisphenol, polycarbonate-C, which is derived from methylbisphenol-A, polyester carbonates, polyesters, alkyd resins, polyamides, polyurethanes, epoxy resins, or mixtures thereof and the like. Preferably, the polymeric binder of the charge transport layer is inactive, i.e., does not exhibit charge transport properties.

In one embodiment of the present invention, the unsaturated aliphatic hydrocarbon comprises a straight or branched hydrocarbon with at least one double bond.

In a preferred embodiment of the present invention, the unsaturated aliphatic hydrocarbon comprises an α-olefin compound of the formula

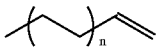

wherein n is from about 10 to about 75. More preferably, n is from about 15 to about 55, and most preferably n is from about 15 to about 30.

In a preferred embodiment, the charge transport layer comprises a charge transport compound and a blend of α-olefin compounds of the formula

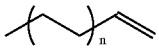

wherein the blend comprises a first α-olefin compound wherein n is from about 21 to about 25 and a second, different α-olefin compound wherein n is from about 21 to about 51.

In one embodiment, the charge transport layer comprises the unsaturated aliphatic hydrocarbon in an amount sufficient to improve one or more photoelectric properties of a photoconductor containing the layer. For example, the charge transport layer may contain the unsaturated aliphatic hydrocarbon in an amount sufficient to improve the negative fatigue of a photoconductor in which the layer is included.

In a preferred embodiment, the charge transport layer comprises from about 0.5 weight percent to about 10 weight percent of the unsaturated aliphatic hydrocarbons and from about 20 weight percent to about 60 weight percent of the charge transport compound. In a more preferred embodiment of the present invention, the charge transport layer comprises from about 1.5 weight percent to about 5 weight percent of the unsaturated aliphatic hydrocarbons and from about 20 weight percent to about 60 weight percent of the charge transport compound. In an even more preferred embodiment, the charge transport layer comprises from about 1.5 weight percent to about 3 weight percent of the unsaturated aliphatic hydrocarbons and from about 20 weight percent to about 60 weight percent of the charge transport compound.

Conventional charge transport compounds suitable for use in the charge transport layer and photoconductors of the present invention should be capable of supporting the injection of photogenerated holes or electrons from the charge generation layer and allowing the transport of these holes or electrons to the charge transport layer surface to selectively discharge the surface charge. Suitable charge transport compounds for use in the charge transport layer include, but are not limited to, the following:

1. Pyrazoline transport molecules as disclosed in U.S. Pat. Nos. 4,315,982, 4,278,746 and 3,837,851.

2. Substituted fluorene charge transport molecules as described in U.S. Pat. No. 4,245,021.

3. Oxadiazole transport molecules such as 2,5-bis(4-diethylaminophenyl)-1,3,4-oxadiazole, imidazole, triazole, and others as described in German Patents Nos. 1,058,836, 1,060,260 and 1,120,875 and U.S. Pat. No. 3,895,944.

4. Hydrazone transport molecules including p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example, in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example, in U.S. Pat. Nos.4,385,106,4,338,388, 4,387,147, 4,399,208 and 4,399,207. Yet other hydrazone charge transport molecules include carbazole phenyl hydrazones such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426. Preferred hydrazone transport molecules include derivatives of aminobenzaldehydes, cinnamic esters or hydroxylated benzaldehydes. Exemplary amino benzaldehyde-derived hydrazones include those set forth in the Anderson et al U.S. Pat. Nos. 4,150,987 and 4,362,798, while exemplary cinnamic ester-derived hydrazones and hydroxylated benzaldehyde-derived hydrazones are set forth in the copending Levin et al U.S. applications Ser. Nos. 08/988,600 now abandonded and 08/988,791, now U.S. Pat. No. 5,925,486. respectively, all of which patents and applications are incorporated herein by reference.

5. Diamine and triarylamine transport molecules of the types described in U.S. Pat. Nos. 4,306,008, 4,304,829, 4,233,384, 4,115,116, 4,299,897, 4,265,990 and/or 4,081,274. Typical diamine transport molecules include N,N'- diphenyl-N,N'-bis(alkylphenyl)-[1,1'-biphenyl]-4,4'-diamines wherein the alkyl is, for example, methyl, ethyl, propyl, n-butyl, or the like, or halogen substituted derivatives thereof, commonly referred to as benzidine and substituted benzidine compounds, and the like. Typical triarylamines include, for example, tritolylamine, and the like.

The charge transport layer will typically have a thickness of from about 10 to about 40 microns and may be formed in accordance with conventional techniques known in the art.

Conveniently, the charge transport layer may be formed by dissolving the charge transport compound, the unsaturated aliphatic hydrocarbons and a polymeric binder in organic solvent, coating the dispersion and/or solution on the respective underlying layer and drying the coating. Likewise, the charge generation layer may be formed by dissolving or dispersing the charge generation compound, the unsaturated aliphatic hydrocarbon and the polymeric binders in organic solvent, coating the solution or dispersion on the respective underlying layer and drying the coating.

Another embodiment of the present invention is directed to a charge generation layer comprising a binder and a charge generation compound. The binder comprises an unsaturated aliphatic hydrocarbon of at least 10 carbon atoms. In a preferred embodiment, the unsaturated aliphatic hydrocarbon comprises an α-olefin compound of the formula

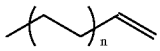

wherein n is from about 10 to about 75. Preferably, n is from about 10 to about 55. More preferably, n is from about 15 to about 55; and even more preferably n is about 15 to about 30. In a preferred embodiment, the binder further comprises a polymer component. Numerous polymeric components suitable for use in charge generation layers are known in the art and may be vital in the charge generation layer binder of the invention. In a preferred embodiment, the charge generation layer binder comprises polyvinylbutyral.

The charge generation layer contains the charge generation compound in an amount sufficient to photogenerate holes or electrons when employed in a photoconductor. Preferably, the charge generation layer comprises from about 5 weight percent to about 80 weight percent of the charge generation compound and from about 20 weight percent to about 95 weight percent of the binder. In a more preferred embodiment, the charge generation layer comprises from about 10 weight percent to about 40 weight percent of the charge generation compound and from about 60 weight percent to about 90 weight percent of the binder.

The unsaturated aliphatic hydrocarbon is preferably included in the charge generation layer in an amount sufficient to improve a photoelectric property of a photoconductor in which the charge generation layer is employed. For example, the unsaturated aliphatic hydrocarbon may be employed in the charge generation layer in an amount sufficient to improve (reduce) dark decay, and increase the sensitivity of a photoconductor in which the layer is employed. In another preferred embodiment, the charge generation layer comprises from about 5 weight percent to about 60 weight percent of the unsaturated aliphatic hydrocarbon, from about 10 weight percent to about 60 weight percent of the charge generation compound and from about 20 to about 95 weight percent of the polymeric copolymer. In a more preferred embodiment, the charge generation layer comprises from about 10 weight percent to about 40 weight percent of the unsaturated aliphatic hydrocarbon, from about 10 weight percent to about 60 weight percent of the charge generation compound and from about 60 to about 90 weight percent of the polymeric component. In yet an even more preferred embodiment, the charge generation layer comprises from about 20 weight percent to about 40 weight percent of the unsaturated aliphatic hydrocarbon, from about 10 weight percent to about 60 weight percent of the charge generation layer and from about 60 to about 80 weight percent of the polymeric component.

As set forth above, the charge generation layer according to the present invention comprises a binder and a charge generation compound. Various organic and inorganic charge generation compounds are known in the art, any of which are suitable for use in the charge generation layers of the present invention. One type of charge generation compound which is particularly suitable for use in the charge generation layers of the present invention comprises squarylium-based pigments, including squaraines. Squarylium pigments may be prepared by an acid route such as that described in U.S. Pat. Nos. 3,617,270, 3,824,099, 4,175,956, 4,486,520 and 4,508,803, which employs simple procedures and apparatus, has a short reaction time and is high in yield. The squarylium pigment is therefore very inexpensive and is easily available.

Preferred squarylium pigments suitable for use in the present invention may be represented by the structural formula (I)

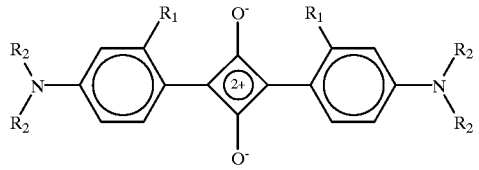

(I)

wherein $R_1$ represents hydroxy, hydrogen or $C_{1-5}$ alkyl, preferably hydroxy, hydrogen or methyl, and each $R_2$ individually represents $C_{1-5}$ alkyl or hydrogen. In a further preferred embodiment, the pigment comprises a hydroxy squaraine pigment wherein each $R_1$ in the formula (I) set forth above comprises hydroxy.

Another type of pigment which is particularly suitable for use in the charge generation layers of the present invention comprises the phthalocyanine-based compounds. Suitable phthalocyanine compounds include both metal-free forms such as the X-form metal-free phthalocyanines and the metal-containing phthalocyanines. In a preferred embodiment, the phthalocyanine charge generation compound may comprise a metal-containing phthalocyanine wherein the metal is a transition metal or a group IIIA metal. Of these metal-containing phthalocyanine charge generation compounds, those containing a transition metal such as copper, titanium or manganese or containing aluminum as a group IIIA metal are preferred. These metal-containing phthalocyanine charge generation compounds may further include oxy, thiol or dihalo substitution. Titanium-containing phthalocyanines as disclosed in U.S. Pat. Nos. 4,664,997, 4,725,519 and 4,777,251, including oxo-titanyl phthalocyanines, and various polymorphs thereof, for example type IV polymorphs, and derivatives thereof, for example halogen-substituted derivatives such as chlorotitanyl phthalocyanines, are suitable for use in the charge generation layers of the present invention.

Another embodiment of the present invention is directed to a photoconductor comprising a substrate, a charge generation layer and a charge transport layer, wherein at least one of the charge transport layer and the charge generation layer comprise one or more unsaturated aliphatic hydrocarbons, wherein the unsaturated aliphatic hydrocarbon comprises at least 10 carbon atoms. In a preferred embodiment of the present invention, the unsaturated aliphatic hydrocarbon comprises an α-olefin compound of the formula

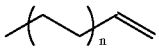

wherein n is from about 10 to about 75. In a more preferred embodiment, n is from about 10 to about 55, and more preferably n is from about 15 to about 55. Yet even more preferably, n is from about 15 to about 30.

In a preferred embodiment, the charge transport layer of the photoconductor comprises from about 0.5 weight percent to about 10 weight percent of the unsaturated aliphatic hydrocarbons and from about 20 weight percent to about 60 weight percent of a charge transport compound. More preferably, the charge transport layer comprises from about 1.5 weight percent to about 5 weight percent of the unsaturated aliphatic hydrocarbons, and even more preferably from about 1.5 weight percent to about 3 weight percent of the unsaturated aliphatic hydrocarbons.

In a preferred embodiment, the charge transport layer of the photoconductor further comprises a binder. Typically, the binder is polymeric and may comprise, but is not limited to, vinyl polymers such as polyvinyl chloride, polyvinyl butyral, polyvinyl acetate, styrene polymers and copolymers of the vinyl polymers, acrylic acid and acrylic polymers and copolymers, polycarbonate polymers and copolymers, including polycarbonate-A, which is derived from bisphenol A, polycarbonate-Z, which is derived from cyclohexylidene bisphenol, polycarbonate-C, which is derived from methyl bisphenol A, polyesters, alkyd resins, polyamides, polyurethanes, epoxy resins, or mixtures thereof and the like.

In a preferred embodiment, the charge transport layer of the photoconductor comprises a charge transport compound and a blend of α-olefin compounds of the formula

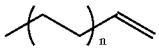

wherein the blend comprises a first α-olefin compound wherein n is from about 21 to about 25 and a second, different α-olefin compound wherein n is from about 21 to about 51.

In another preferred embodiment, the charge generation layer of the photoconductor comprises from about 5 weight percent to about 60 weight percent of the unsaturated aliphatic hydrocarbon and from about 10 weight percent to about 60 weight percent of a charge generation compound. More preferably, the charge generation layer comprises from about 10 weight percent to about 40 weight percent of the unsaturated aliphatic hydrocarbon, and most preferably from about 20 weight percent to about 40 weight percent of the unsaturated aliphatic hydrocarbon in the charge generation layer.

In another embodiment of the present invention, a formed photoconductor comprises a substrate, a charge generation layer and a charge transport layer, wherein at least one of the charge transport layer and charge generation layer comprises one or more α-olefin compounds of the formula

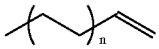

wherein n is from about 10 to about 75 and wherein the photoconductors comprise the α-olefin compounds in an amount sufficient to improve at least one photoelectric property of the formed photoconductor. The term formed photoconductor is used to refer to a photoconductor comprising a charge generation layer and a charge transport layer, wherein substantially all of the solvent has been evaporated from each of the charge generation layer and the charge transport layer.

In another embodiment of the present invention, a formed photoconductor comprises a substrate, a charge generation layer and a charge transport layer, wherein at least one of the charge transport layer and charge generation layer comprises one or more α-olefin compounds of the formula

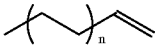

wherein n is from about 10 to about 75, and wherein the formed photoconductor comprises at least 0.5 weight percent of the α-olefin compound. In a more preferred embodiment, n is from about 10 to about 55; more preferably is from 15 to about 55; and most preferably n is from about 15 to about 30.

The following examples demonstrate various embodiments and advantages of the charge transport layers, charge generation layers, and/or photoconductors according to the present invention. In the examples and throughout the present specification, parts and percentages are by weight unless otherwise indicated.

EXAMPLE 1

In this example, photoconductors according to the present invention and comparative photoconductors were prepared using charge transport layers according to the present invention and conventional charge transport layers, respectively. Each of the photoconductors described in this example was prepared by dip-coating a charge generation layer dispersion on an aluminum substrate, followed by dip-coating a charge transport layer dispersion on the dried charge generation layer. In each of the photoconductors, the charge generation layer comprised about 45 weight percent of a type-IV polymorph of titanyl phthalocyanine (TiOPc) and about 55 weight percent of a polymeric binder comprising polyvinyl butyral, formed from a dispersion as described in Table 1.

TABLE 1

| Dispersion Material | Relative Percent (weight) |
|---|---|
| Methylethyl Ketone | 87.3 |
| Cyclohexanone | 9.70 |
| Titanyl phthalocyanine | 1.35 |
| Polyvinyl butyral | 1.65 |

The charge transport layers of the respective photoconductors according to the invention in this example comprised polymeric binder, an α-olefin compound and a charge transport compound. The charge transport compound selected for this example was p-diethylaminobenzaldehyde-diphenyl hydrazone (DEH). As described in Table 2, the charge transport layers contained additional additives. As will be apparent from Table 2, photoconductor 1A is a comparative photoconductor containing none of the α-olefin compound. Photoconductors 1B—1E contained an α-olefin compound according to the present invention. Specifically, photoconductors 1B and 1C contained an α-olefin compound of the formula

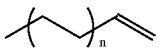

wherein n=17–21 in the charge transport layer of the photoconductor, while photoconductors 1D and 1E contained an α-olefin compound of the indicated formula wherein n=21–25 in the charge transport layer of the photoconductor and photoconductors 1F and 1G contained an α-olefin compound of the indicated formula wherein n=21–51 in the charge transport layer of the photoconductors.

TABLE 2

| Dispersion Material, Relative Percent (wt) | Relative Percent (wt) Photoconductors 1A | 1B | 1C | 1D | 1E | 1F | 1G |
|---|---|---|---|---|---|---|---|
| tetrahydrofuran | 59.96 | 59.78 | 59.66 | 59.78 | 59.66 | 59.78 | 59.66 |
| 1,4-dioxane | 19.99 | 19.92 | 19.88 | 19.92 | 19.88 | 19.92 | 19.88 |
| DEH | 7.99 | 7.97 | 7.96 | 7.97 | 7.96 | 7.97 | 7.96 |
| DC-200 | 0.01 | 0.01 | 0.01 | 0.01 | 0.01 | 0.01 | 0.01 |
| polycarbonate A | 11.92 | 11.89 | 11.86 | 11.89 | 11.86 | 11.89 | 11.86 |
| savinyl yellow | 0.13 | 0.13 | 0.13 | 0.13 | 0.13 | 0.13 | 0.13 |
| α-olefin | — | 0.3* | 0.5* | 0.3** | 0.5** | 0.3*** | 0.5*** |

*α-olefin wherein n = 17–21
**α-olefin wherein n = 21–25
***α-olefin wherein n = 21–51

The charge generation dispersion described in Table 1 was coated on aluminized mylar (Dupont) and cured at 100° C. for 15 minutes. The charge transport solutions described in Table 2 were coated over the respective charge generation layer and cured at 120° C. for one hour. Drum optical density and sensitivity measurements were made using an electrostatic sensitometer fitted with electrostatic probes to measure the voltage magnitude as a function of light energy shining on the photoconductive surface using a 820 nm laser. The drum was charged by a corona and the expose-to-develop time for all measurements was 250 milliseconds. The photosensitivity was measured as a discharge voltage on the photoconductor drum previously charged to about −650V, measured at a light energy of 0.55 $\mu J/cm^2$ as a function of cycles. Drum optical density was measured using a MacBeth TR524 sensitometer. A summary of the measured coating and electrophotographic properties is set forth in Table 3.

TABLE 3

| Photo-conductor | Initial Coating and Electrical Properties: Coat Weight ($mg/in^2$) | Optical Density | Initial Charge (−V) | Charge @ 2.2K (−V) | Negative Photoconductor Voltage @ 0.55 $\mu J/cm^2$ With Cycle # 3 | 1000 | 2000 | 2200 |
|---|---|---|---|---|---|---|---|---|
| 1A* | 15.9 | 1 | 654 | 655 | 180 | 161 | 166 | 170 |
| 1B | 15.1 | 1 | 702 | 700 | 129 | 125 | 140 | 143 |
| 1C | 16.4 | 1 | 677 | 608 | 181 | 274 | 351 | 350 |
| 1D | 16.3 | 1 | 688 | 675 | 186 | 318 | 419 | 417 |
| 1E | 17.1 | 1 | 710 | 697 | 196 | 410 | 488 | 478 |
| 1F | 15.7 | 1 | 707 | 699 | 142 | 210 | 248 | 247 |
| 1G | 18.2 | 1 | 727 | 702 | 184 | 246 | 288 | 286 |

*control

As shown in Table 3, the negative fatigue effect imparted by the use of α-olefin charge transport additives can be noted. The control formulation shows a slight positive fatigue (−180 V to −170 V), while all photoconductors containing the α-olefin compounds show moderate to dramatic negative fatigue. For example, photoconductor 1C, shows an initial discharge of −181 V and a discharge voltage after 2.2K cycles of −350 V.

The dark decay of the photoconductors 1A–1G was also measured both initially and with cycling as shown in Table 4. Dark decay is the loss of charge from the surface of the photoconductor when it is maintained in the dark. Dark decay is an undesirable feature as it reduces the contrast potential between image and background areas, leading to washed out images and loss of gray scale. Dark decay also reduces the field that the photoconductor process will experience when light is brought back to the surface, thereby reducing the operational efficiency of the photoconductor.

TABLE 4

| Photoconductor | Initial Dark Decay (1 second) (V/sec) | Dark Decay @ 2.2K Cycles | Percent Difference |
|---|---|---|---|
| 1A* | 107 | 153 | +43 |
| 1B | 66 | 92 | +39 |
| 1C | 81 | 63 | +22 |
| 1D | 66 | 46 | −30 |
| 1E | 40 | 25 | −38 |
| 1F | 51 | 48 | −6 |
| 1G | 46 | 46 | 0 |

*control

As shown in Table 4, the dark decay improvement imparted by the use of α-olefin charge transport additives can be noted. The greatest improvement is observed with the two higher molecular weight α-olefin-containing photoconductors. The presence of the α-olefin compound of the formula

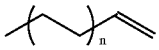

wherein n=21–25 in photoconductors 1D and 1E leads to a decrease in dark decay over 2.2K cycles, while the presence of α-olefin compound where n=21–51 in photoconductors 1F and 1G stabilizes the dark decay relative to the control.

EXAMPLE 2

In this example, photoconductors according to the present invention and comparative photoconductors were prepared using charge transport layers according to the present invention and conventional charge transport layers, respectively. Each of the photoconductors described in this example was prepared by dip-coating a charge generation layer dispersion on an aluminum substrate, followed by dip-coating a charge transport layer dispersion on the dried charge generation layer. In each of the photoconductors, the charge generation layer comprised about 45 weight percent of a Type IV polymorph of titanyl phthalocyanine charge generation compound and about 55 weight percent of a polymeric binder, specifically polyvinyl butyral, prepared from the dispersion as shown in Table 1 of Example 1.

The charge transport layers of the respective photoconductors according to the invention in this example comprised polymeric binder, an α-olefin compound and a charge transport compound. As described in Table 5, the charge transport compound comprised N,N'-diphenyl-N,N'-di(m-tolyl)-p-benzidine (TPD). As will be apparent from Table 5, photoconductor 2A is a comparative photoconductor whereas photoconductors 2B–2D are photoconductors containing charge transport layers according to the present invention and comprise α-olefin compounds in the charge transport layer. Photoconductor 2A comprises 30% by weight of the charge transport compound and 70% by weight of the polymeric binder as shown in Table 5, whereas photoconductor 2B comprises 30 weight percent of a charge transport compound (TPD), 1.5 weight percent of an α-olefin compound of the formula

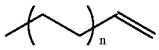

wherein n=17–21 and about 69 weight percent of a polymeric binder. Similarly, photoconductor 2C comprises about 30 weight percent of a charge transport compound (TPD), about 1.5 weight percent of an (α-olefin compound of the indicated formula wherein n=21–25 and about 69 weight percent of a polymeric binder. Photoconductor 2D comprises about 30 weight percent of a charge transport compound (TPD), about 1.5 weight percent of an α-olefin compound of the indicated formula wherein n=21–51, and about 69 weight percent of a polymeric binder.

TABLE 5

| Dispersion Material, | Relative Percent (weight) Photoconductor | | | |
|---|---|---|---|---|
| Relative Percent (weight) | 2A* | 2B | 2C | 2D |
| tetrahydrofuran | 61.49 | 61.49 | 61.49 | 61.49 |
| 1,4-dioxane | 20.49 | 20.49 | 20.49 | 20.49 |
| TPD | 5.4 | 5.4 | 5.4 | 5.4 |
| DC-200 | 0.01 | 0.01 | 0.01 | 0.01 |
| polycarbonate-A | 12.61 | 12.34 | 12.34 | 12.34 |
| α-olefin (n = 17–21) | — | 0.27 | — | — |
| α-olefin (n = 21–25) | — | — | 0.27 | — |
| α-olefin (n = 21–51) | — | — | — | 0.27 |

*control

The charge generation dispersion described in Table 1 was coated over aluminized mylar (Dupont) and cured at 100° C. for 15 minutes. The charge transport solutions described in Table 5 were coated over the charge generation layers and cured at 120° C. for one hour. The samples were exposed to 2.2K charge/discharge cycles.

Various coating and electrostatic properties described in Example 1 were measured. Table 6 depicts a summary of the coating and electrostatic properties.

TABLE 6

| Initial Coating and Electrical Properties | | | | | Negative Photoconductor Voltage @ 0.55 $\mu J/cm^2$ With Cycle # | | | |
|---|---|---|---|---|---|---|---|---|
| Photo-conductor | Coat Weight ($mg/in^2$) | Optical Density | Initial Charge (−v) | Charge @ 2.2K | 3 | 1000 | 2000 | 2200 |
| 2A* | 18.64 | 1.01 | 687 | 637 | 165 | 162 | 159 | 160 |
| 2B | 18.82 | 1.02 | 708 | 696 | 145 | 143 | 142 | 141 |
| 2C | 18.43 | 1.02 | 683 | 691 | 147 | 159 | 158 | 160 |
| 2D | 18.48 | 0.99 | 676 | 687 | 126 | 153 | 159 | 162 |

*control

As can be noted in Table 6, the negative fatigue trend of the photoconductors is as follows: 2B<2C<2D. This trend is graphically illustrated in FIG. 1 with a graph of the voltages at 0.55 $\mu J/cm^2$ cycling divided by the initial potential ($V/V_0$) for each photoconductor. FIG. 1 demonstrates the increased negative fatigue characteristics imparted by the use of increasing molecular weight α-olefin compounds.

The dark decay properties of photoconductors 2A–2D were also measured. The results of the dark decay measurements are set forth in Table 7.

TABLE 7

| Photo-conductor | Initial Dark Decay (−V) | Dark Decay @ 2.2K Cycles (−V) | Percentage Difference |
|---|---|---|---|
| 2A | 79 | 107 | +35 |
| 2B | 51 | 76 | +25 |

TABLE 7-continued

| Photo-conductor | Initial Dark Decay (−V) | Dark Decay @ 2.2K Cycles (−V) | Percentage Difference |
|---|---|---|---|
| 2C | 46 | 53 | +15 |
| 2D | 51 | 48 | −6 |

As shown in Table 7, the dark decay improved with the addition of an α-olefin compound in the photoconductor. The dark decay is initially lower for all formulations containing the α-olefin compounds in the photoconductors. The dark decay change with cycling is also more stable for all three photoconductors 2B–2D containing α-olefin compounds relative to the comparative photoconductor 2A.

EXAMPLE 3

In this example, photoconductors according to the present invention and comparative photoconductors were prepared using charge transport layers according to the present invention and conventional charge transport layers, respectively. Each of the photoconductors described in this example was prepared by dip-coating a charge generation layer dispersion on an aluminum substrate followed by dip-coating a charge transport layer dispersion on the dried charge generation layer. In each of the photoconductors, the charge generation layer comprised about 45 weight percent of a type IV polymorph of titanyl phthalocyanine charge generation compound and about 55 weight percent of a polymeric binder prepared from a dispersion as shown in Table 1.

The charge transport layers of the respective photoconductors according to this example comprise polymeric binder and a charge transport compound. As described in Table 8, compositions 3C and 3D contained additional additives, respectively. As will be apparent from Table 8, photoconductors 3A and 3B are comparative photoconductors, whereas photoconductors 3C and 3D are photoconductors containing charge transport layers according to the present invention with photoconductor 3C comprising an α-olefin compound of the formula

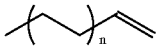

wherein n=21–25 and wherein the α-olefin compound comprises 1.5 weight percent of the charge transport layer; and photoconductor 3D comprises an α-olefin compound of the indicated formula wherein n=21–51 and wherein the α-olefin compound comprises 2.5 weight percent of the charge transport layer. Photoconductors 3A–3D comprise N,N'-diphenyl-N,N'-di(m-tolyl)-p-benzidine (TPD) as the charge transport compound.

TABLE 8

| Dispersion Material | Photoconductor | | | |
|---|---|---|---|---|
| Relative Percent (wt) | 3A* | 3B* | 3C | 3D |
| tetrahydrofuran | 61.49 | 61.49 | 61.49 | 61.49 |
| 1,4-dioxane | 20.49 | 20.49 | 20.49 | 20.49 |
| TPD | 5.4 | 5.4 | 5.4 | 5.42 |
| DC-200 | 0.01 | 0.01 | 0.01 | 0.01 |
| polycarbonate-A | 12.61 | 12.61 | 12.34 | 12.16 |
| α-olefin (n = 21–25) | — | — | 0.27 | — |
| α-olefin (n = 21–51) | — | — | — | 0.45 |

*control

Charge generation dispersions were prepared as described in Table 1 and dip-coated over cylindrical aluminum substrates. The charge generation layers were then dried at 100° C. for 15 minutes. Charge transport solutions described in Table 8 were then dip-coated over the charge generation layer and cured for one hour at 120° C. The drums were then placed in Optra S345°® (Lexmark International Corporation) printers and run through the end of the cartridge life in a four page and pause duplex mode. Table 9 summarizes the coating properties and electrostatic properties measured as described in Example 1 with the exception that the drum optical density and sensitivity measurements were made using an electrostatic sensitometer fitted with electrostatic probes to measure the voltage magnitude as a function of light energy shining on the photoconductive surface using a 780 nm laser. The drum was charged by a corona and the expose-to-develop time for all measurements was 76 milliseconds.

TABLE 9

| Initial Coating and Electrical Properties | | | | | | | | |
|---|---|---|---|---|---|---|---|---|
| | Coat | | | | Print Properties | | | |
| Photo-conductor | Weight (mg/in$^2$) | Optical Density | Charge (−V) | Residual (−V) | Prints | Usage* | Charge BOL/EOL** | Discharge BOL/EOL*** |
| 3A | 16.8 | 1.6 | 849 | 105 | 26,444 | 12.0/7.4 | 890/873 | 165/139 |
| 3B | 16.1 | 1.6 | 851 | 98 | 23,291 | 15.6/4.1 | 894/874 | 130/109 |
| 3C | 16.5 | 1.4 | 851 | 105 | 25,004 | 15.4/5.6 | 885/914 | 166/161 |
| 3D | 16.1 | 1.6 | 851 | 120 | 25,076 | 15.3/5.1 | 882/895 | 132/152 |

*Milligrams of toner printed on the page/milligrams of toner sent to the cleaner.
**BOL/EOL = Beginning of Life/End of Life.
***Voltage at which an all black page is printed.

As shown in Table 9, the incorporation of an 1.5% α-olefin compound in photoconductor 3C mitigated the positive fatigue of the discharge voltage from the beginning of life versus end of life measurements. Similarly, the use of a 2.5% α-olefin compound in photoconductor 3D resulted in a negative fatigue of the discharge voltage. As shown in Table 9, the two control drums 3A and 3B have large positive fatigues of the discharge voltage.

EXAMPLE 4

In this example, photoconductors according to the present invention and comparative photoconductors were prepared using charge transport layers according to the present invention and conventional charge transport layer and charge generation layers, respectively. The photoconductors 3A and 3D from Example 3 were again produced. The photoconductor drums were exposed to either hand oils (fingerprints) or polyethylene glycol (PEG), then cleaned with isopropanol and aged at 50° C. for up to six days. The control drum was rated a 5 on the crazing scale of 1–10 wherein zero corresponds to no crazing. The results are summarized in Table 10.

TABLE 10

| Photoconductor | Fingerprint Induced Crazing 6 Day Rating | PEG-Induced Crazing 5 Day Rating |
|---|---|---|
| 3A | 5 | 5 |
| 3D | 0 | 0 |

As shown in Table 10, the presence of an α-olefin compound in the charge transport layer of photoconductor 3D has eliminated drum crazing.

EXAMPLE 5

In this example, photoconductors according to the present invention and comparative photoconductors were compared using charge generation layers according to the present invention and conventional charge generation layers, respectively. Each of the photoconductors described in this example was prepared by dip-coating a charge generation layer dispersion on an aluminum substrate, followed by dip-coating a charge transport layer dispersion on the charge generation layer. In each of the photoconductors of this example, the dried charge transport layer comprised about 30 weight percent N,N'-diphenyl-di(m-tolyl)-p-benzidine (TPD) and about 70 weight percent of a polymeric binder.

The charge generation layers of the respective photoconductors according to the invention in this example comprised a polymeric binder, an α-olefin compound and a charge generation compound Type IV polymorph of titanyl phthalocyanine (TiOPc) was used as a charge generation compound. As will be apparent from Table 11, photoconductor 5A is a comparative photoconductor, whereas photoconductors 5B and 5D contain charge generation layers according to the present invention and comprise an α-olefin compound of the formula

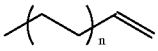

wherein n=17–21 in photoconductor 5B, n=21–25 in photoconductor 5C and n=21–51 in photoconductor 5D.

The charge generation dispersions were dip-coated over cylindrical aluminum substrates. The charge generation layers were then dried at 100° C. for 15 minutes. The charge transport solution was dip-coated over the charge generation layer and cured for one hour at 120° C.

TABLE 11

| Dispersion Material | Photoconductor | | | |
|---|---|---|---|---|
| Relative Percent (wt) | 5A* | 5B | 5C | 5D |
| Methylethyl Ketone | 88.32 | 88.32 | 88.32 | 88.32 |
| Cyclohexanone | 7.08 | 7.08 | 7.08 | 7.08 |
| Titanyl phthalocyanine | 1.60 | 1.60 | 1.60 | 1.60 |
| Polyvinylbutyral | 3.0 | 1.83 | 1.83 | 1.83 |
| α-olefin (n = 17–21) | — | 1.17 | — | — |
| α-olefin (n = 21–25) | — | — | 1.17 | — |
| α-olefin (n = 21–51) | — | — | — | 1.17 |

*control

The photoconductors of this example were subject to measurement of various electrostatic properties as described in Example 3, with the addition of measurement of negative photoconductor voltage at various laser energies. The results of these measurements are set forth in Table 12.

TABLE 12

| | Initial Coating and Electrical Properties | | | | Negative Photoconductor Voltage at Given Laser Energy (μJ/cm²) | | | | |
|---|---|---|---|---|---|---|---|---|---|
| | Coat | | | Dark Decay | | | | | |
| Photo-conductor | Weight (mg/in²) | Optical Density | Charge (−V) | @ 1 sec. (−V) | 0.1 | 0.2 | 0.4 | 0.7 | 1.1 (Residual) |
| 5A | 17 | 1.5 | 857 | 225 | 529 | 318 | 166 | 117 | 104 |
| 5B | 16.7 | 1.5 | 849 | 149 | 499 | 237 | 96 | 84 | 81 |
| 5C | 16.4 | 1.5 | 852 | 154 | 511 | 250 | 95 | 80 | 76 |
| 5D | 16.6 | 1.5 | 848 | 164 | 511 | 256 | 98 | 82 | 78 |

Table 12 demonstrates the surprising results in reduced dark decay and reduced residual voltage exhibited by photoconductors 5B–5D utilizing a combination of an α-olefin compound in an otherwise standard charge generation layer. The lower voltages correspond to each laser energy, and the trend is consistent throughout the entire energy range. Also as noted in Table 12, the dark decay is significantly lower with photoconductors 5B–5D of the present invention than comparative photoconductor 5A.

EXAMPLE 6

In this example, photoconductors according to the present invention and comparative photoconductors were prepared using charge transport layers according to the present invention and conventional charge transport layers, respectively. Each of the photoconductors described in this example was prepared by dip-coating a charge generation layer dispersion on a cylindrical anodized aluminum substrate followed by dip-coating a charge transport layer dispersion on the dried charge generation layer. In each of the photoconductors, the charge generation layer comprised about 45 weight percent of a type IV polymorph of titanyl phthalocyanine charge generation compound and about 55 weight percent of a polymeric binder prepared from a dispersion as shown in Table 1.

The charge transport layers of the respective photoconductors according to this example comprise polymeric binder and a charge transport compound. As described in Table 13, compositions 6C and 6D contained additional additives, respectively. As will be apparent from Table 13, photoconductors 6A and 6B are comparative photoconductors, whereas photoconductors 6C and 6D are photoconductors containing charge transport layers according to the present invention with charge transport layers of photoconductors 6C and 6D comprising a blend of α-olefin compounds of the formula

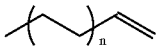

wherein the blend comprises a first α-olefin compound wherein n is from 21 to 25 and a second, different α-olefin compound wherein n is from 21 to 5 1. Photoconductors 6A–6D comprise N,N'-diphenyl-N,N'-di(m-tolyl)-p-benzidine (TPD) as the charge transport compound.

TABLE 13

| Dispersion Material | Photoconductor | | | |
|---|---|---|---|---|
| Relative Percent (wt) | 6A* | 6B* | 6C | 6D |
| tetrahydrofuran | 61.49 | 61.49 | 61.49 | 61.49 |
| 1,4-dioxane | 20.49 | 20.49 | 20.49 | 20.49 |
| TPD | 5.4 | 5.4 | 5.4 | 5.4 |
| DC-200 | 0.01 | 0.01 | 0.01 | 0.01 |
| polycarbonate-A | 9.46 | 9.46 | 9.11 | 9.11 |
| polycarbonate-Z | 3.15 | 3.15 | 3.09 | 3.09 |
| α-olefin (n = 21–25) | — | — | 0.27 | 0.27 |
| α-olefin (n = 21–51) | — | — | 0.14 | 0.14 |

*control

Charge generation dispersions were prepared as described in Table 1 and dip-coated over cylindrical aluminum substrates. The charge generation layers were then dried at 100° C. for 15 minutes. Charge transport solutions as described in Table 13 were then dip-coated over the charge generation layer and cured for one hour and 120° C. Drums were exposed to 1000 charge/discharge cycles on an in-house electrostatic tester using a 780 nm laser and an expose-to-develop time of 76 ms. Comparisons were made between photoconductors with similar discharge (residual) potentials. The results are summarized in Table 14.

TABLE 14

| Photo-conductor | Charge (−V) | 0.2 μJ/cm² (−V) | 0.4 μJ/cm² (−V) | Residual (−V) | Dark Decay (V/sec) |
|---|---|---|---|---|---|
| 6A* | 849/845 | 333/294 | 201/176 | 164/145 | 71/132 |
| 6B* | 849/848 | 298/268 | 211/184 | 182/161 | 69/117 |

TABLE 14-continued

| Photo-conductor | Charge (−V) | 0.2 μJ/cm² (−V) | 0.4 μJ/cm² (−V) | Residual (−V) | Dark Decay (V/sec) |
|---|---|---|---|---|---|
| 6C | 853/841 | 337/358 | 193/236 | 153/199 | 49/93 |
| 6D | 848/851 | 370/372 | 224/268 | 181/235 | 58/84 |

*Control

As shown in Table 14, the incorporation of a blend of α-olefin compounds in photoconductors 6C and 6D resulted in negative fatigue of the discharge voltage and more stable dark decay with cycling.

These examples demonstrate that the photoconductors according to the present invention exhibit surprising results in the mitigation or elimination of the electrophotographic fatigue and reduction or elimination of crazing that commonly occur in standard charge transport layers and/or charge generation layers in photoconductors.

The various embodiments and examples set forth herein are to further illustrate the claimed invention and are not intended to be limiting thereof. Additional embodiments and alternatives within the scope of the claimed invention will be apparent to those of ordinary skill in the art.

We claim:

1. A charge transport layer, comprising a charge transport compound and one or more unsaturated aliphatic hydrocarbons, wherein the unsaturated aliphatic hydrocarbon comprises at least 10 carbon atoms.

2. The charge transport layer as defined by claim 1, wherein the unsaturated aliphatic hydrocarbon comprises one or more α-olefin compounds of the formula

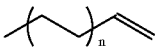

wherein n is from about 10 to about 75.

3. The charge transport layer as defined by claim 1, comprising from about 0.5 weight percent to about 10 weight percent of the unsaturated aliphatic hydrocarbon and from about 20 weight percent to about 60 weight percent of the charge transport compound.

4. The charge transport layer as defined by claim 1, comprising from about 1.5 weight percent to about 5 weight percent of the unsaturated aliphatic hydrocarbon and from about 20 weight percent to about 60 weight percent of the charge transport compound.

5. The charge transport layer as defined by claim 1, comprising from about 1.5 weight percent to about 3.0 weight percent of the unsaturated aliphatic hydrocarbon and from about 20 weight percent to about 60 weight percent of the charge transport compound.

6. The charge transport layer as defined by claim 1, further comprising a binder.

7. The charge transport layer as defined by claim 6, wherein the binder comprises polyvinyl chloride, polyvinyl butyral, polyvinyl acetate, styrene polymer, polycarbonate-A, polycarbonate-Z, polycarbonate-C, polyester carbonate, polyester, alkyd resin, polyamide, polyurethane, epoxy resin, or mixtures thereof.

8. The charge transport layer as defined by claim 2, comprising from about 0.5 weight percent to about 10 weight percent of α-olefin compound and from about 20 weight percent to about 60 weight percent of the charge transport compound.

9. The charge transport layer as defined by claim 2, comprising from about 1.5 weight percent to about 5 weight percent of α-olefin compound and from about 20 weight percent to about 60 weight percent of the charge transport compound.

10. The charge transport layer as defined by claim 2, comprising from about 1.5 weight percent to about 3.0 weight percent of α-olefin compound and from about 20 weight percent to about 60 weight percent of the charge transport compound.

11. The charge transport layer as defined by claim 2, further comprising a binder.

12. The charge transport layer as defined by claim 11, wherein the binder comprises polyvinyl chloride, polyvinyl butyral, polyvinyl acetate, styrene polymer, polycarbonate-A, polycarbonate-Z, polycarbonate-C, polyester carbonate, polyester, alkyd resin, polyamide, polyurethane, epoxy resin, or mixtures thereof.

13. The charge transport layer as defined by claim 2, wherein n is from about 15 to about 55.

14. The charge transport layer as defined by claim 2, wherein n is from about 15 to about 30.

15. A charge generation layer, comprising a binder and a charge generation compound, wherein the binder comprises an unsaturated aliphatic hydrocarbon, and further wherein the unsaturated aliphatic hydrocarbon comprises at least 10 carbon atoms.

16. The charge generation layer as defined by claim 15, wherein the unsaturated aliphatic hydrocarbon comprises one or more α-olefin compounds of the formula

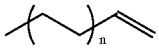

wherein n is from about 10 to about 75.

17. The charge generation layer as defined by claim 15, wherein the binder further comprises polyvinyl butyral.

18. The charge generation layer as defined by claim 15, comprising from about 5 to about 80 weight percent of the charge generation compound and from about 20 to about 95 weight percent of the binder.

19. The charge generation layer as defined by claim 15, comprising from about 10 to about 40 weight percent of the charge generation compound and from about 60 to about 90 weight percent of the binder.

20. The charge generation layer as defined by claim 15, comprising from about 5.0 weight percent to about 60 weight percent of the unsaturated aliphatic hydrocarbon and from about 10 weight percent to about 60 weight percent of the charge generation compound.

21. The charge generation layer as defined by claim 15, comprising from about 10 weight percent to about 40 weight percent of the unsaturated aliphatic hydrocarbon and from about 10 to about 60 weight percent of the charge generation compound.

22. The charge generation layer as defined by claim 15, comprising from about 20 weight percent to about 40 weight percent of the unsaturated aliphatic hydrocarbon and from about 10 to about 60 weight percent of the charge generation layer.

23. The charge generation layer as defined by claim 15, wherein n is from about 10 to about 55.

24. The charge generation layer as defined by claim 15, wherein n is from about 15 to about 30.

25. A photoconductor, comprising a substrate, a charge generation layer and a charge transport layer, wherein at least one of the charge transport layer and charge generation layer comprise one or more unsaturated aliphatic hydrocarbons, and further wherein the unsaturated aliphatic hydrocarbon comprises at least 10 carbon atoms.

26. The photoconductor as defined by claim 25, wherein the unsaturated aliphatic hydrocarbon comprises α-olefin compounds of the formula

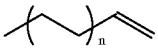

wherein n is from about 10 to about 75.

27. The photoconductor as defined by claim 25, wherein the charge transport layer comprises from about 0.5 weight percent to about 10 weight percent of the unsaturated aliphatic hydrocarbon and from about 20 weight percent to about 60 weight percent of a charge transport compound.

28. The photoconductor as defined by claim 25, wherein the charge generation layer comprises from about 5.0 weight percent to about 60 weight percent of the unsaturated aliphatic hydrocarbon and from about 10 weight percent to about 60 weight percent of a charge generation compound.

29. A formed photoconductor comprising a substrate, a charge generation layer and a charge transport layer, wherein at least one of the charge transport layer and charge generation layer comprises one or more α-olefin compounds of the formula

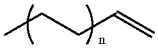

where n is from about 10 to about 75, and wherein the photoconductor comprises α-olefin compounds in an amount sufficient to improve at least one photoelectric property of the formed photoconductor.

30. A formed photoconductor comprising a substrate, a charge generation layer and a charge transport layer, wherein at least one of the charge transport layer and charge generation layer comprises one or more α-olefin compounds of the formula

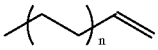

where n is from about 10 to about 75, and wherein the formed photoconductor comprises at least 0.5 weight percent of the α-olefin compounds.

31. The charge transport layer as defined by claim 2, wherein the α-olefin compound comprises an α-olefin compound wherein n is from about 21 to about 25 and an α-olefin compound wherein n is from about 21 to about 51.

32. The photoconductor as defined by claim 26, wherein the charge transport layer comprises a charge transport compound and an α-olefin compound wherein n is from about 21 to about 25 and an α-olefin compound wherein n is from about 21 to about 51.

* * * * *